US007530751B2

(12) United States Patent
Journe

(10) Patent No.: US 7,530,751 B2
(45) Date of Patent: May 12, 2009

(54) WRITING IMPLEMENT

(75) Inventor: Francois-Paul Journe, Geneva (CH)

(73) Assignee: Montres Journe S.A., Geneva (CH)

( * ) Notice: Subject to any disclaimer, the term of this patent is extended or adjusted under 35 U.S.C. 154(b) by 0 days.

(21) Appl. No.: 12/100,839

(22) Filed: Apr. 10, 2008

(65) Prior Publication Data

US 2008/0317541 A1 Dec. 25, 2008

(30) Foreign Application Priority Data

Apr. 13, 2007 (EP) ..... 07405119

(51) Int. Cl.
*B43K 5/16* (2006.01)

(52) U.S. Cl. ..... 401/108; 401/107

(58) Field of Classification Search ..... 401/99, 401/107, 108

See application file for complete search history.

(56) References Cited

U.S. PATENT DOCUMENTS 2,952,242 A * 9/1960 Rosso ..... 401/108
2006/0029456 A1* 2/2006 Liu ..... 401/108

FOREIGN PATENT DOCUMENTS

| | | | |
|---|---|---|---|
| DE | 15 61 830 | A1 | 4/1970 |
| EP | 1 095 588 | A2 | 5/2001 |
| FR | 987 385 | A | 8/1951 |
| FR | 1 419 821 | A | 12/1965 |

OTHER PUBLICATIONS

European Search Report of Priority European Application No. 07405119.4; date of mailing Sep. 14, 2007.

* cited by examiner

*Primary Examiner*—David J Walczak
(74) *Attorney, Agent, or Firm*—Westerman, Hattori, Daniels & Adrian, LLP.

(57) ABSTRACT

Writing implement (1) of longitudinal axis (2), comprising an essentially tubular body (30), a retractable nib (10), an actuator (35) and a retractor (40) for retracting said nib (10). It also comprises a guard member (20) comprising a plurality of guard petals (21), each mounted so as to be able to move between an open position and a closed position about a pivot axis (22), and a movement transfer mechanism (31). This last is integral with said body (30), is synchronized by said retractor (40), and is connected to said guard petals (21) to transfer the movement applied to the actuator (35) into a pivoting movement of said guard petals.

12 Claims, 3 Drawing Sheets

WRITING IMPLEMENT

The present invention relates to a writing implement, especially an ink-type writing implement, preferably such as a fountain pen.

Such implements comprise a body, a nib such as a fountain pen-style nib or a rolling ball or a felt tip, in the case of fountain pens, ballpoint pens and felt-tip pens, respectively, and a cap by way of a protective member for the nib.

The cap may be a member perceived as undesirable or impractical in that it is detachable and is easy to lose or at least mislay temporarily. It is known, however, that the cap has at least a protective function as regards the nib, because it protects the nib from knocks and also ensures that the ink of the nib cannot dry out in the open air. Another purpose of the cap is to protect surrounding objects from accidental ink marks which could inadvertently be left when handling the writing implement.

With the object of reducing the problems of the cap, the prior art already includes ballpoint pens whose nib can be simply retracted into the body of the pen. Such retraction occurs typically after pressing or rotating an actuator, usually situated on the body, at the opposite end from the nib end. In the so-called retracted position, the nib can nonetheless be seen inside the body of the pen when looking at it end-on. Although such implements are suitable for ballpoint nibs, they become unsuitable for felt-tip nibs or fountain pen-style nibs. The problem with felt-tip nibs is that they require a completely closed protection, such as that afforded by a cap, in order to prevent the ink with which the felt is soaked from drying out. The same applies to fountain pens, which additionally do not readily lend themselves to retraction of the nib into the body or into a sheath because of the size of the nib, which is substantially greater than that of a ballpoint or felt-tip.

Document FR987385A discloses a writing implement provided with a nib guard member. The guard member is formed of a plurality of petals which are pivoted open and closed by means of an actuator located at the opposite end from the nib. The ink cartridge acts as the intermediate means connecting the nib to the actuator through the body of the implement. A ring connected to the cartridge is mounted level with the pivot axis of the petals. The opening/closing principle of the guard member is based on the axial displacement of this ring which, when pushed against the convex inner surface of the petals, forces the petals to pivot in one direction or the other and thus open/close the guard member.

Document DE1561830A1 discloses another opening system for the guard petals of a nib. This system is based on the pressure which the edge of a bearing of the shank of the nib is able to apply to the inner end surface of the petals. For this purpose the petals are connected to the body of the implement through an attachment region formed by a weakening slot between the body and the guard petals. This system thus operates on the basis of the relative elasticity of these petals compared with the body of the implement at each of these attachment regions.

Another writing implement provided with a retractable nib protection device is disclosed in document FR-A-1419821. This retractable device takes the form of an elastic strip shaped to close an opening through which the nib is able to pass. This strip has a hump in contact with the inner sheath carrying the nib. The protection member comes open after the inner sheath is pushed forward against the hump. In this way the elastic strip can move out of the way of the tip, leaving the opening free for the nib to come out. The nib is then extended by continuing the translational movement applied to the inner sheath.

It is an object of the present invention to at least partly solve the problems indicated above by providing a writing implement that has no cap or similar removable member, but which nonetheless can provide effective protection to any type of nib, both against impact and against deterioration of the ink on the nib. The subject of the present invention is preferably intended to accommodate a fountain pen-style nib, so that the complete product is a capless fountain pen.

To this end, the present invention relates to a writing implement as set out in claim 1.

This member advantageously makes a cap unnecessary but still provides the protection afforded by such a member principally to the nib. Moreover, the implement of the present invention can also be secured to an object by means of an attachment means, commonly knows as a clip, even though the latter is usually joined to the cap in the great majority of fountain pens known in the prior art. Another object of the present invention is to provide a writing implement that has a nib retraction system which in addition is at the very least unusual.

Other advantages will become apparent in the light of the following description, which refers to a preferred embodiment of the subject of the present invention, taken without implying any limitation and illustrated schematically and by way of example in the appended figures listed below.

Figure 1:
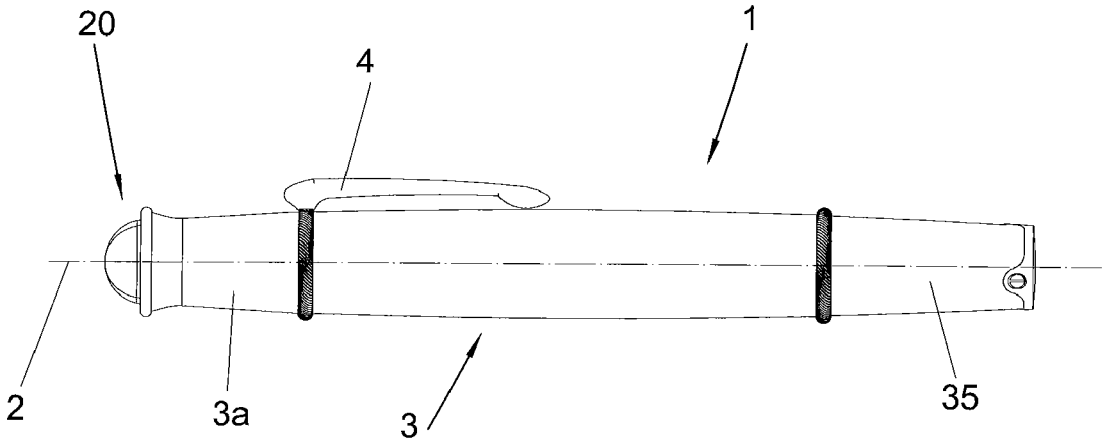
FIG. 1 is a side view of the subject matter of the present invention in a first or closed configuration.
Figure 2:
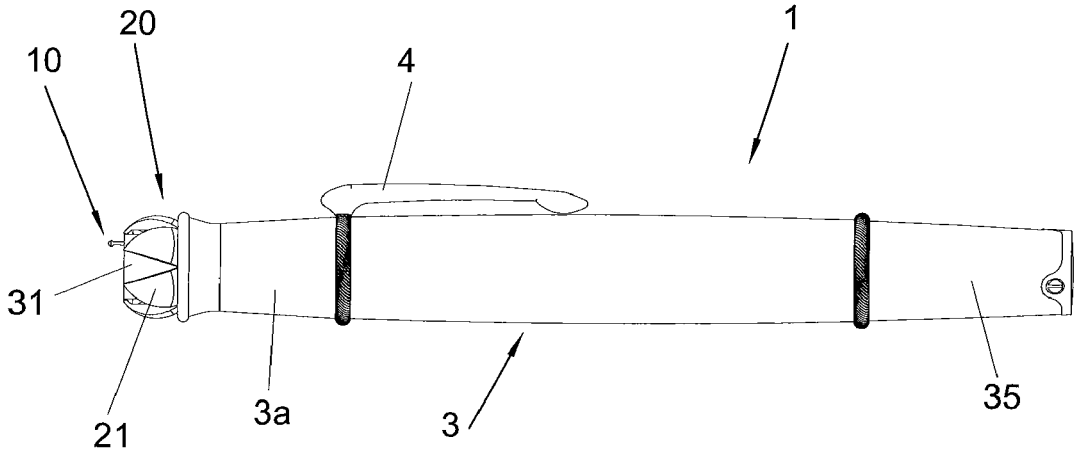
FIG. 2 is a view similar to that of FIG. 1 but in a second or intermediate configuration.
Figure 3:
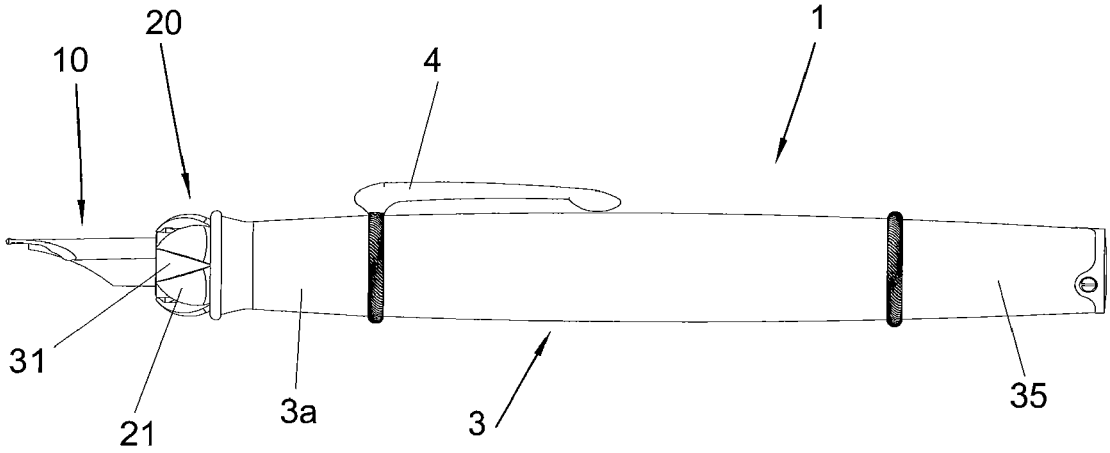
FIG. 3 is a view similar to those of FIGS. 1 and 2 but in a third or open configuration.

Referring to the illustrations given in FIGS. 1 to 3, these show a writing implement 1, in particular a fountain pen, in three different configurations. The first or closed configuration corresponds to that of FIG. 1 where the retractable nib 10 is completely concealed inside a guard member 20. The second or intermediate configuration corresponds to that shown in FIG. 2 where the guard member 20 is open but the nib 10 is not yet extended, at least not completely extended from this member or from the outer sheath 3 of the writing implement. The third or open configuration corresponds to that of FIG. 3, where the nib is fully extended and the implement is ready for use.

As regards terminology, and to avoid any ambiguity in the following account, the terms "front", "forward", "rear" and the like will be used with reference to the elongated general shape of the writing implement 1 and the nib will be said to be at the front or forward end of this implement.

Figure 4:
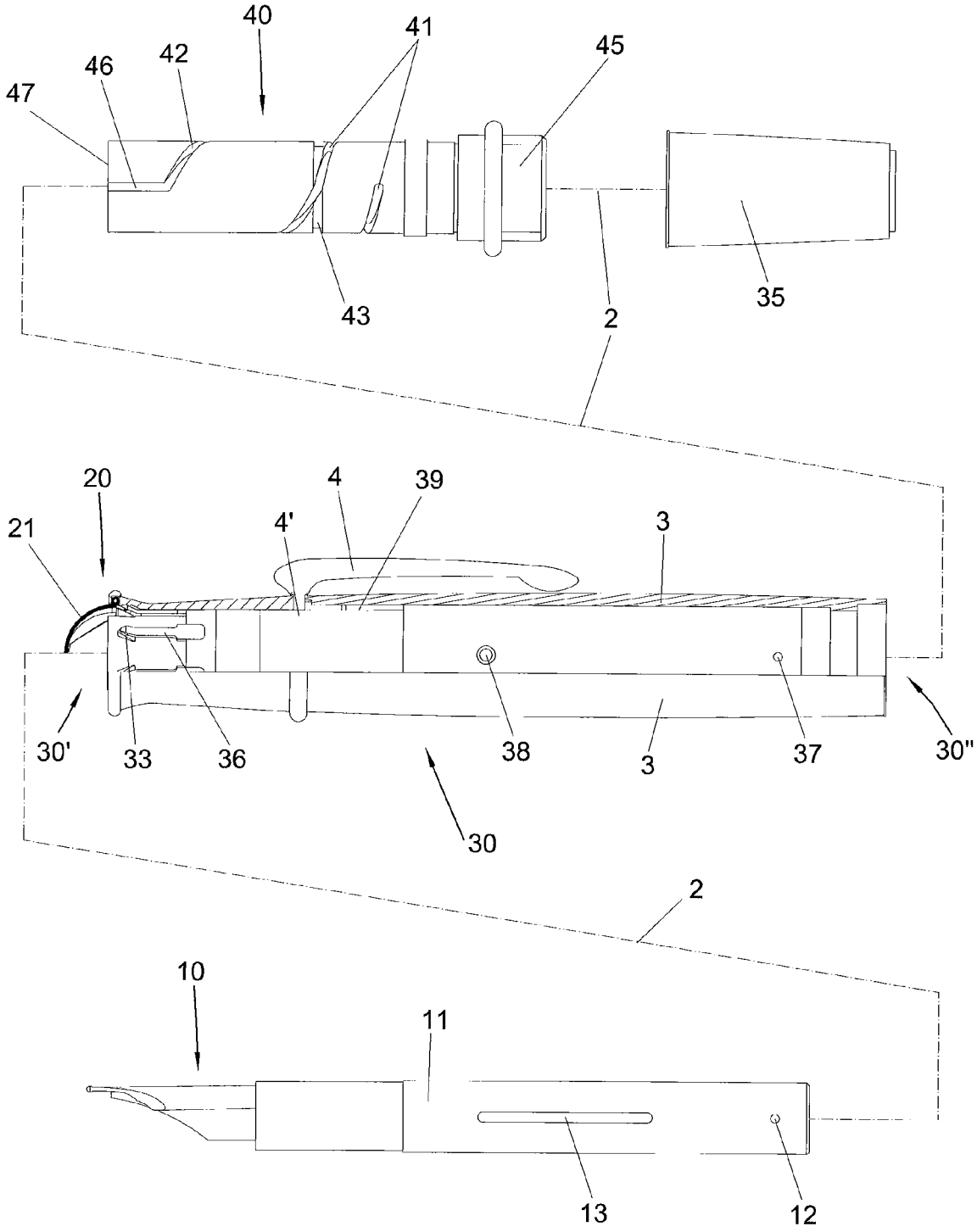
FIG. 4 is a side view in partial section of the component members of the writing implement, shown disassembled along a single longitudinal axis.

As illustrated in FIG. 4, the writing implement 1 of the present invention has a longitudinal axis 2 and an essentially tubular body 30. The retractable nib 10 is mounted in an open end 30' of this body. At the opposite end 30" is an actuator 35 which is the means by which the user can control the guard member and the nib, as illustrated in FIGS. 1 to 3. A retracting means 40 for retracting the nib connects the latter to the actuator 35 through the body 30. This retracting means 40 makes it possible in particular to transfer a movement applied to the actuator into a displacement of the nib along the longitudinal axis 2, between a retracted position and an extended position.

In the present invention, the guard member of the open end 30' has a plurality of guard petals 21, each mounted so as to pivot between a closed position, clearly visible in FIG. 1, and an open position illustrated for example in FIG. 2. In this latter position, the guard member recalls the corolla of a flower, with the guard petals 21 corresponding to the petals of the flower.

Figure 5:
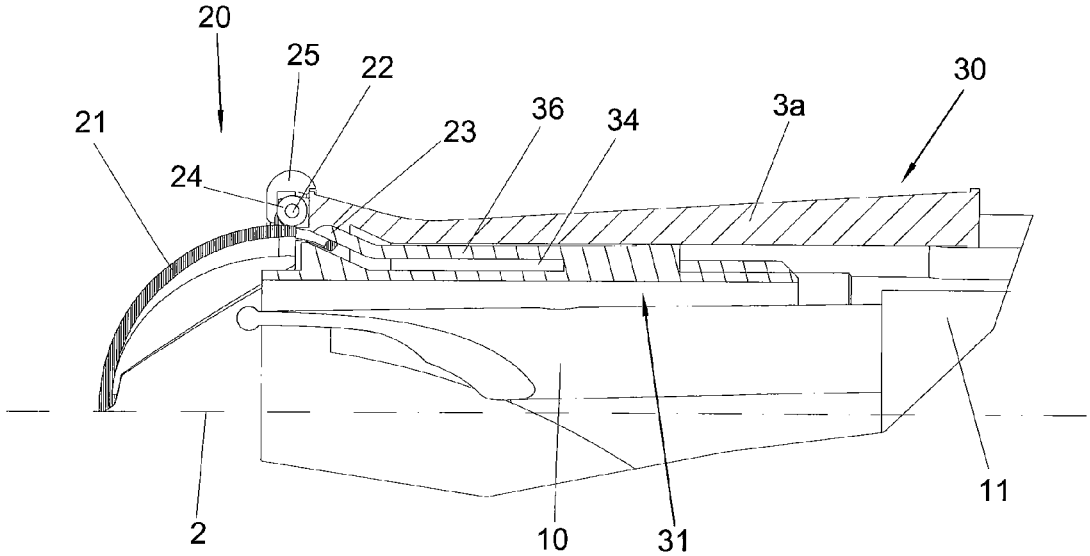
FIG. 5 is a detail view in partial cross section of the front portion of the subject matter of the invention as illustrated in FIG. 1.
Figure 6:
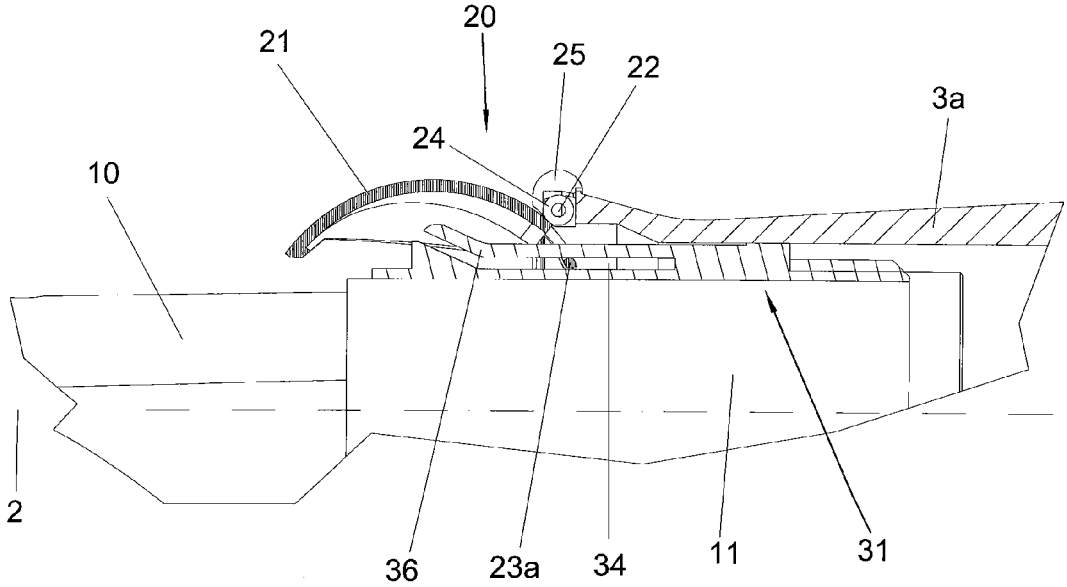
FIG. 6 is a detail view in partial cross section of the front portion of the subject matter of the invention as illustrated in FIG. 2.

FIGS. 5 and 6 are detail views of the guard member 20 as shown in FIGS. 1 and 2, respectively. They depict the opening and closing movement of this member by the pivoting of each of the guard petals 21 about a pivot axis 22 tangent to an imaginary circle that is concentric with the longitudinal axis 2. This movement is caused by a movement transfer means 31 designed specifically to transfer the movement brought about by the user on the actuator 35 into a pivoting movement of the guard petals. For this purpose, this movement transfer means is partly connected to the guard petals 21 and partly integral with the body 30.

In the preferred embodiment, the movement transfer means 31 consists of a plurality of linear cams 33 integral with the body 30, for example recessed into or mounted on the latter, preferably at its front end. Each linear cam 33 is read by a cam feeler 23 corresponding to one of the guard petals 21. The cam feeler 23 is designed to travel along the path 34 of the linear cam 33. The pivot axis 22 of each guard petal 21 takes the physical form of a small shaft passing through a bearing 24. The latter is made integral with the front portion 3*a* of the outer sheath 3, for example by crimping it into a collar 25, which is preferably a hollow torus, as shown in FIGS. 5 and 6.

In the invention, the cam feeler 23 of each of the guard petals is advantageously shaped like a stirrup in which the opening is traversed by a guide tongue 36 forming the linear cam 33. This feeler forms a lever arm attached to the guard petal 21 and is designed to be able to pivot through a few degrees about its bearing point, which is the shaft whose axis is on the pivot axis 22. Thus, the guard petal 21, its bearing 24 and the cam feeler 23 are parts which are connected together and can pivot together about the pivot axis 22.

The opening and closing movement of the guard member 20 is brought about by the translational movement of the linear cams 33 along the longitudinal axis 2. As an example, taking the closed position as shown in FIG. 5 as the starting point, and proceeding to the open position shown in FIG. 6, the forward movement of each linear cam 33 forces the cam feeler 23 of each guard petal 21 to follow the path 34 of the cam. The shape of this path forces the free end 23*a* of the cam feeler 23 to move toward the longitudinal axis 2, which causes each of the guard petals 21 to swing up about its individual pivot axis 22 as shown in FIG. 6. A rearward movement of the linear cam 33 produces the reverse movement, closing the guard petals of the guard member 20.

Axial displacement of the linear cams 33 is explained below with the help of FIG. 4. The latter shows the main internal components of the writing implement which produce on the one hand the axial displacements of the linear cams 33 to open and close the guard member 20, and on the other hand the translational movements of the nib 10 relative to the outer sheath 3 or to the guard member.

These axial displacements are produced by the retracting means 40 which are the central control member of the writing implement 1. This member is designed to be housed essentially inside the body 30. It is moved by the actuator 35, which is preferably separate from the nib retractor means and is connected to the rear end of the retractor means by a screw thread 45, for example. In the preferred embodiment of the present invention, the retractor means 40 is a cylindrical cam so that the rotational movement applied to it through the actuator 35 is able to convert this circular movement into a translational movement transmitted to the linear cams 33 and to the nib 10 as explained below.

In order to do this, the cylindrical cam 40 comprises as a minimum a first helix 41 and a second helix 42. These helixes preferably take the form of helical grooves formed in the cylinder of the cam 40. As a variant, the helixes could be conceived to be helical threads protruding from the cylinder of this cam. The first helix 41 is intended to be read by a first cam feeler 37 integral with the body 30, in particular with the rear part of this body. When the cylindrical cam 40 is rotated through a certain angle about the longitudinal axis 2, the first helix 41 will, through the first cam feeler 37, move the body 30 axially through a distance proportional to the pitch of this first helix. For a rotation of the cam equivalent for example to one complete revolution, the translational movement of the body 30 will be equal to the pitch of the first helix.

Because the linear cams 33 are attached to the body 30, movement of the latter will pivot the guard petals 21 of the guard member 20. To prevent the body 30 from moving translationally any further if the rotation is continued beyond that which is necessary to completely open the guard petals 21, it has been provided, in the preferred embodiment of the present invention, that the cylindrical cam 40 also includes a circular path 43. The latter is located between the two helixes 41, 42, at the end of the first helix 41, that is to say at the forward end of the path of this helix. Any rotation of the cylindrical cam 40 after that which is necessary to operate the guard member 20 will thus have no effect on this member because the first cam feeler 37 will follow the circular path 43, which path, having a zero pitch, cannot produce any translational movement of the body 30.

The second helix 42 is designed to be read by a second cam feeler 12 integral with the nib 10, in particular with the rear of an inner sheath 11 connected to this nib. By the same principle as described above, the second helix 42 will aim to move the nib 10 in a back and forth movement depending on the direction of rotation of the cam 40. Engagement of the second cam feeler 12 with the second helix 42 will convert the circular movement applied to the cylindrical cam into a translational movement applied to the nib 10. In the preferred embodiment of the present invention, the translational movement of this nib takes place after that of the body 30, even though both movements are generated by the rotation of the same cylindrical cam. However, it will be understood that these movements could in a variant be accomplished at least partly simultaneously.

Because of the circular cam 43, it becomes possible to have the translational movement of the nib 10 generated by the rotation of the cam 40 within an angular range exceeding that necessary to operate the guard member 20. To take an example, a first revolution of the cylindrical cam 40 will first open the petals of the guard member, and a second revolution will then fully extend the nib 10 from the body 30, in this case out of the guard member 20.

The pitches and relative positions of the helixes around the cylindrical cam 40 advantageously make it possible to determine the relative speeds of the movements of the controlled members, and to synchronize these movements, respectively. For a given speed of rotation of the cylindrical cam, the speeds of the movements of the controlled members will be proportional to the pitch of their corresponding helix. In a variant, it would also be possible for the pitch of at least one of the helixes 41, 42 to be irregular along its path. In such a case, the tangent to the helix would undergo at least one variation in its value along its curve.

Although in the preferred embodiment of the invention the helixes 41, 42 are formed one after the other on the cylinder of the retractor means 40, they could also be intertwined. In another form, the helixes could also be connected to each other by a circular path 43.

The cylinder of the cam 40 is preferably hollow to enable it to house at least part of the inner sheath 11 connected to the nib 10, while this cylindrical cam is in turn intended to be housed in the body 30.

Preferably also, the second helix 42 terminates at its forward end in an essentially linear portion 46 leading all the way to the end face 47 at the front of the cam 40. This arrangement facilitates the assembly/disassembly both of the inner sheath 11 inside the cylindrical cam, and of this cam 40 inside the body 30. Moreover, the junction between the second helix 42 and the portion 46 which follows it gives the second cam feeler 12 a corner to negotiate, which advantageously acts as a stop to prevent any rearward translation of the nib 10 when moderate pressure is placed on the latter. By this locking means, any unintentional retraction of the nib during writing is thus essentially prevented.

As can be seen clearly in FIG. 4, the invention also has the nib guided by its inner sheath 11 with the aid of a guide means. The latter is preferably made up of a slot 13, formed for example in the central part of this sheath, and a guide pin 38 integral with the body 30. The linear slot is designed to be read by this guide pin. Since, in the preferred embodiment, the nib is intended to be able to describe a back-and-forth movement from the front to the rear only, the slot 13 is oriented in the direction of the longitudinal axis 2 so that it will only permit this movement.

The writing implement also has a locking means for preventing rotation of this body. For this purpose the locking means preferably consists of a locking slot 39 oriented in the direction of the longitudinal axis 2, with a locking tooth engaged in this slot. In the invention, this locking tooth is the attachment end 4' of a clip 4 illustrated in FIGS. 1 to 4. Allowing the pen to be clipped to the edge of a pocket, this clip is connected to the body 30. The straight form of the locking slot, oriented along the longitudinal axis 2, does not interfere with the translational movement of the body 30 used in operating the guard member 20 through the movement transfer means 31, in particular the linear cams 33.

Advantageously also, the direction of the clip 4, as mounted on the outer sheath 3 visible in FIG. 1, can be used to fasten the writing implement 1 in a vertical position, keeping the front end of this implement uppermost. The ink contained for example in the reservoir of the fountain pen will not therefore drain toward the nib in such a position.

In the preferred embodiment, the actuator 35 is a rotary actuator. A first rotation of the actuator in a first direction will produce a first change of configuration; for example that corresponding to the guard member 20 being open. A second rotation of the actuator, in the same direction, will produce a second change of configuration; for example that corresponding to the nib being extended, as shown in FIG. 3.

To prevent any malfunction, the opening/closing movements of the guard member 20 and those of the nib are kept in step with each other by the retractor means 40 synchronizing the movement transfer means 31. This synchronization is caused by the relative positions of the two helixes 41, 42 described above.

As described thus far, the movement of the nib 10 consists of an axial displacement in the direction of the longitudinal axis 2. However, it is also conceivable that the nib could be given another movement, such as an additional rotary movement.

The guard member 20 preferably comprises six guard petals which shut to form a completely closed envelope. With this envelope, the nib is inside a housing protected from any contact with the exterior, and thus from the surrounding air and preferably from light.

It will be observed too that the expression "transfer a movement", used in relation to the retractor means 40 and in relation to the movement transfer means 31, is used to signify that the corresponding movement may either be simply transmitted, or transmitted and converted. Such a conversion of movement would be intended for example to change a rotary movement into a movement of axial translation. Although this conversion is preferably done by means of the cylindrical cam as regards the retractor means 40, it would of course be possible to produce the same effect by means of some other conversion system, such as a pinion meshing with a rack or a system of a link rod or a piston mounted on a wheel.

The invention claimed is:

1. A writing implement having a longitudinal axis, comprising an essentially tubular body, a retractable nib mounted at an open end of this body, an actuator located at the opposite end of this body, a retractor means for retracting said nib and connecting the nib to the actuator through said body and transferring a movement applied to the actuator into a displacement of said nib along the longitudinal axis between a retracted position and an extended position, a guard member of said open end comprising a plurality of guard petals, each mounted so as to be able to move between an open position and a closed position about a pivot axis tangent to a circle concentric with the longitudinal axis, and a movement transfer means integral with said body, synchronized by said retractor means, and connected to said guard petals to transfer the movement applied to the actuator into a pivoting movement of said guard petals; in which implement said retractor means consists of a cylindrical cam comprising a first helix read by a first cam feeler integral with the body, and a second helix read by a second cam feeler integral with said nib.

2. The writing implement as claimed in claim 1, in which said cylindrical cam also includes a circular path located between said helixes, at one end of the first helix.

3. The writing implement as claimed in claim 2, in which said cylindrical cam is made hollow to accommodate at least part of an inner sheath connected to the nib.

4. The writing implement as claimed in claim 2, in which the second helix terminates, at the opposite end from the end adjacent to the first helix, in an essentially rectilinear portion.

5. The writing implement as claimed in claim 1, in which said cylindrical cam is made hollow to accommodate at least part of an inner sheath connected to the nib.

6. The writing implement as claimed in claim 5, in which said first helix and said second helix are located one after the other.

7. The writing implement as claimed in claim 1, in which the movement transfer means consists of a plurality of linear cams read by cam feelers, each connected to one of said guard petals.

8. The writing implement as claimed in claim 1, in which said first helix and said second helix are located one after the other.

9. The writing implement as claimed in claim 1, in which the second helix terminates, at the opposite end from the end adjacent to the first helix, in an essentially rectilinear portion.

10. The writing implement as claimed in claim 1, that includes a locking means to prevent rotation of said body.

11. The writing implement as claimed in claim 10, in which said locking means consists of a locking slot oriented in the direction of the longitudinal axis, and a locking tooth engaged with said locking slot.

12. The writing implement as claimed in claim 1, that comprises a means for guiding the nib in its axial displacement.

* * * * *